US007712309B2

(12) United States Patent
Vigholm

(10) Patent No.: US 7,712,309 B2
(45) Date of Patent: May 11, 2010

(54) ARRANGEMENT AND A METHOD FOR CONTROLLING A WORK VEHICLE

(75) Inventor: Bo Vigholm, Stora Sundby (SE)

(73) Assignee: Volvo Construction Equipment AB, Eskilstuna (SE)

( * ) Notice: Subject to any disclaimer, the term of this patent is extended or adjusted under 35 U.S.C. 154(b) by 244 days.

(21) Appl. No.: 11/813,773

(22) PCT Filed: Feb. 17, 2005

(86) PCT No.: PCT/SE2005/000226

§ 371 (c)(1),
(2), (4) Date: Jul. 12, 2007

(87) PCT Pub. No.: WO2006/088399

PCT Pub. Date: Aug. 24, 2006

(65) Prior Publication Data

US 2008/0104953 A1 May 8, 2008

(51) Int. Cl.
*F16D 31/02* (2006.01)

(52) U.S. Cl. ..... 60/414; 60/419

(58) Field of Classification Search ..... 60/414, 60/419, 484, 461; 91/454
See application file for complete search history.

(56) References Cited

U.S. PATENT DOCUMENTS

| | | | | |
|---|---|---|---|---|
| 6,378,301 | B2 | 4/2002 | Endo et al. | |
| 6,467,264 | B1 * | 10/2002 | Stephenson et al. | 60/484 |
| 6,725,581 | B2 | 4/2004 | Naruse et al. | |
| 6,789,387 | B2 | 9/2004 | Brinkman | |
| 6,854,268 | B2 * | 2/2005 | Fales et al. | 60/414 |
| 2004/0035103 | A1 | 2/2004 | Nagura et al. | |
| 2006/0156713 | A1 | 7/2006 | Kadlicko | |

FOREIGN PATENT DOCUMENTS

WO 2006060638 A2 6/2006

OTHER PUBLICATIONS

International Search Report for corresponding International Application PCT/SE2005/000226.

* cited by examiner

*Primary Examiner*—Michael Leslie
(74) *Attorney, Agent, or Firm*—WRB-IP LLP

(57) ABSTRACT

An arrangement for controlling a work vehicle includes a power source, and a hydraulic circuit including a pump driven by the power source, at least one hydraulic actuator arranged in fluid connection with the pump via a first conduit, a variable displacement hydraulic motor unit arranged in fluid connection with the actuator and downstream the actuator via a second conduit. The variable displacement hydraulic motor unit is arranged for controlling movement of the actuator.

29 Claims, 4 Drawing Sheets

ARRANGEMENT AND A METHOD FOR CONTROLLING A WORK VEHICLE

BACKGROUND AND SUMMARY

The present invention relates to an arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream the actuator via a second conduit. The invention is also related to a method for controlling a work vehicle.

The pump is normally operatively driven by an internal combustion engine arranged for propelling the work vehicle.

The term work vehicle comprises different types of material handling vehicles like construction machines, such as a wheel loader, a backhoe loader, a motor grader and an excavator. The invention will be described below in a case in which it is applied in a wheel loader. This is to be regarded only as an example of a preferred application.

Said actuator may be a linear actuator in the form of a hydraulic cylinder. A wheel loader comprises several such hydraulic cylinders in order to perform certain work functions. A first pair of hydraulic cylinders is arranged for turning (steering) the wheel loader. A second pair of hydraulic cylinders is arranged for lifting a load arm unit and a further hydraulic cylinder is arranged on the load arm unit for tilting an implement, for example a bucket or forks, arranged on the load arm unit.

Conventional hydraulic systems normally comprise a directional valve arranged upstream of the hydraulic actuator for controlling the supply of fluid from the pump to the actuator and thereby also the movement of the actuator. The directional valve is adjusted in a continuously variable way according to a desired movement of the implement. Thus, the fluid flow from the pump is throttled to a greater or lesser extent in order to achieve the desired movement.

Prior art hydraulic systems have some energy losses during operation. Some of these energy losses are described below.

For example, when a function is actuated, the load is brought to a certain speed (for example during steering of the vehicle). Braking the load to a lower speed or to a stop is done by throttling the fluid. The kinetic energy from the load is thereby transmitted to the fluid via the valve outlet.

Further, there is a risk of vehicle instability in certain situations. For example, when the vehicle is steered by means of the associated actuators, the vehicle may bounce sideways.

Further, during a lifting operation of the implement, it is first raised to a certain level by supplying the associated actuators with hydraulic energy. This energy is transferred to potential energy when the implement is in the raised position. This energy is throttled via said valve when the implement is lowered. The loss of energy is particularly high when a load is lowered (for example when a pallet is lowered from a rack).

Further, during a tilting operation of the implement (in the form of a bucket) , it is first tilted upwards to a certain level by supplying the associated actuator with hydraulic energy. This energy is transferred to potential energy when the implement is in the raised position. This energy is throttled via said valve when the implement is tilted downwards again.

Further, when the implement is lowered and when the implement (bucket) is emptied, respectively, the gravity acts as a downward force. The pump continue to pump also in this situation, when only the gravity force in principle could be used to move the implement.

It is known to use a so-called Load Sensing hydraulic system (LS system) in the work vehicle. The LS system comprises means for sensing a load pressure subjected to the actuator during operation. More specifically, the load is sensed and the output pressure of the pump is controlled so that it exceeds the load pressure existing in the actuator by a predetermined differential. More specifically, the pressure (an LS signal) from the actuator for the load may be sensed via a shuttle valve and via an activated control valve unit associated with the actuator for the load. The pump then delivers a hydraulic fluid flow to the actuator, the level of which depends on the extent to which the activated control valve unit is operated.

The LS system generally has a relatively high efficiency. However, the LS-system has some energy losses. Some of these energy losses are described below.

The pump in a conventional load-sensing system works for keeping a constant pressure drop over the directional valve. The flow is determined by the opening area of the valve. The magnitude of the pressure drop depends on the system design and valve type, but is normally 10-25 Bar. A wheel loader is often operated with a low number of revolutions of the engine and several work functions are performed at the same time. This leads to that the pump is unable to saturate the pressure of the valves when they are fully opened, which in turn leads to lower pressure drops.

When several work functions are actuated at the same time in a LS-system with a common pump, the pump needs to generate a pressure level that can handle the highest actuator pressure. This means that the valves controlling the further actuator(s) (functions), will get very high pressure drop, which will be throttled away in the associated valve.

Oil resources are becoming more scarce in the world, which increases the prices of oil-based fuels. The efficiency of vehicles requiring oil-based fuels therefore becomes more important in the future. For work vehicles, there is a problem of energy losses in the hydraulic systems.

In U.S. Pat. No. 6,789,387, a hydraulic system for recovering energy in a work vehicle is disclosed. The system is arranged to recover energy during an overrunning load condition, i.e when a hydraulic cylinder is retracted due to its own weight after it has been extended to lift a load. An overrunning load condition is sensed and a valve is thereafter actuated so that a fluid from the cylinder is directed to a hydraulic motor for producing a torque output. One disadvantage is that the system is limited to recover energy only during said overrunning condition.

In U.S. Pat. No. 6,725,581, a hydraulic system for recovering energy in a work vehicle is disclosed. The system comprises several hydraulic actuators for performing different work functions. Several switches are arranged for guiding a return oil from one of said hydraulic actuators depending on a detected back pressure of the actuators. A pump motor is rotatably driven by the return oil from the selected hydraulic actuator. A dynamo-electric generator is coupled to the pump motor for generating electric power from the rotary force of the pump motor. One disadvantage is that the system is limited to recover energy for only one work function at the same time.

It is desirable to create conditions for a system that is more energy-efficient than previously known systems and solves or at least relieves some of the problems discussed above.

According to an aspect of the present invention, the means for controlling movement of the actuator is formed by the variable displacement hydraulic motor unit. Thus, the fluid is pumped in the hydraulic circuit from the pump to the actuator via the first conduit and in return from the actuator to the hydraulic motor unit via the second conduit and further to a reservoir. The wording "movement of the actuator" refers in this case to the speed of the actuator.

Thus, the hydraulic motor unit, which is arranged downstream of the actuator, is used for controlling the movement of the actuator. Hence, no directional control valve is required upstream of the actuator for controlling the actuator and the abovementioned problems with throttling losses are eliminated. Further, the variable displacement hydraulic motor unit is preferably the only means for controlling movement of the actuator.

Thus, the means for controlling movement of the actuator is formed by the variable displacement hydraulic motor unit in combination with that the fluid connection through the first conduit from the pump to the actuator is free from actuator movement controlling throttling means.

According to an aspect of the invention, the fluid is directly supplied from the pump to the actuator. In other words, the fluid connection through the first conduit from the pump to the actuator is free from throttling means, i.e the first conduit is fully open and the fluid flow is supplied to the actuator is a non-manipulated, non- throttled manner.

According to an aspect of the invention, the arrangement comprises means for electrically controlling the displacement of the variable displacement motor unit. Said electrical control means is preferably formed by a controller.

The control of the displacement may be done in response to receiving a work function signal from an operator maneuverable control lever. The signal from the operator lever may further be manipulated in the controller. For example, ramps for initiating and terminating an actuator movement, respectively, may be stored in a memory and used for displacement control. The displacement of the motor unit may also be regulated according to a sensed operating parameter of the vehicle, such as the number of revolutions of the power source. The movement of the actuator may thereby be controlled in an effective and smooth way.

According to a further aspect of the invention, the motor unit is arranged for a rotation connection to the power source in order to transmit energy to the power source.

By virtue of this arrangement, any excess hydraulic energy supplied by the pump is recovered back to the power source via the hydraulic motor unit. Excess hydraulic energy is supplied by the pump when it is working at an unnecessary high pressure level (which is the case for example in a system with a constant pump pressure).

Further, a potential energy achieved when the implement is raised to a raised position is recovered by the motor unit and transmitted to the power source when the implement is lowered. The recovery of energy is particularly high when a load is lowered (for example when a pallet is lowered from a rack).

Since the hydraulic motor unit is connected to the power source such that it transmits energy from the fluid flow to the power source, the problem of energy losses in the conventional directional valve is solved and any excess hydraulic energy provided by the pump may be recovered in the hydraulic motor unit.

According to a further aspect of the invention, the arrangement comprises a set of on/off valves arranged on the first and second conduit for actuating the associated hydraulic actuator. Thus, these on/off valves are adapted to be arranged in one of two end positions; a first position, in which the fluid connection is fully open and a second position, in which the fluid connection is fully closed. The above mentioned problem with pressure drop is thereby substantially solved. The movement of the on/off valve from one end position to the other end position may be controlled in a continuous way so that the transition is not too abrupt. For example, the first and last part of the movement distance may comprise a ramp for a smooth operation.

In the case of a hydraulic cylinder for controlling a work function, there are two input conduits to and two output conduits from the cylinder. A first input conduit is connected to a piston side and a first output conduit is connected to a piston rod side. A second input conduit is connected to the piston rod side and a second output conduit is connected to the piston side. An on/off valve is arranged on each of these four input/output conduits and by simultaneously open the on/off valves at the first conduits or the second conduits, the cylinder can be moved in different directions by means of the pressurized fluid from the pump. Preferably, the controller is arranged for electrically controlling the on/off valves based on operator command signals.

According to a further aspect of the invention, the arrangement comprises means for sensing a load pressure subjected to the actuator during operation. By using the load-sensing system in the control arrangement according to the invention, several energy losses associated with hydraulic systems with conventional control of the actuator (via a directional valve upstream of the actuator) may be relieved.

According to a further aspect of the invention, the arrangement comprises a plurality of hydraulic actuators for performing a plurality of work functions, and that one variable displacement motor unit is arranged for controlling each work function. Thus, each work function, like steering, lift and tilt is connected to a separate motor unit. In this way, the movement of each actuator may be controlled independently from the other actuators. The recovery of energy is especially efficient when several work functions are used simultaneously. The pump supplies a sufficiently high pressure for the highest loaded work function and all excess energy is recovered via the motor units.

According to a further aspect of the invention, the power source is connected in such a way to at least one further energy using system/component in the vehicle that energy recovered by the motor unit may be transmitted to it. For example, when the implement is lowered, the energy recovered by the motor unit is larger than the -energy supplied by the pump due to the fact that the motor unit will receive the potential energy of the load arm unit and the load. This excess energy can be used by the power source to drive for example the vehicle driveline and/or further vehicle systems like the service brake system and/or components like fans and generators etc.

The term "driveline" is in the following referred to as the arrangement downstream the engine for transmitting power from the engine to the vehicle ground engaging members (wheels or tracks).

It is also desirable to achieve a control method that is more energy-efficient than previously known methods and solves or at least relieves some of the problems discussed above.

A method according to An aspect of the present invention is also disclosed.

Further advantageous embodiments and further advantages of the invention emerge from the detailed description below.

BRIEF DESCRIPTION OF THE DRAWINGS

The invention will be explained below, with reference to the embodiments shown on the appended drawings, wherein FIG. 1 schematically shows a wheel loader in a side view.

DETAILED DESCRIPTION

Figure 1:
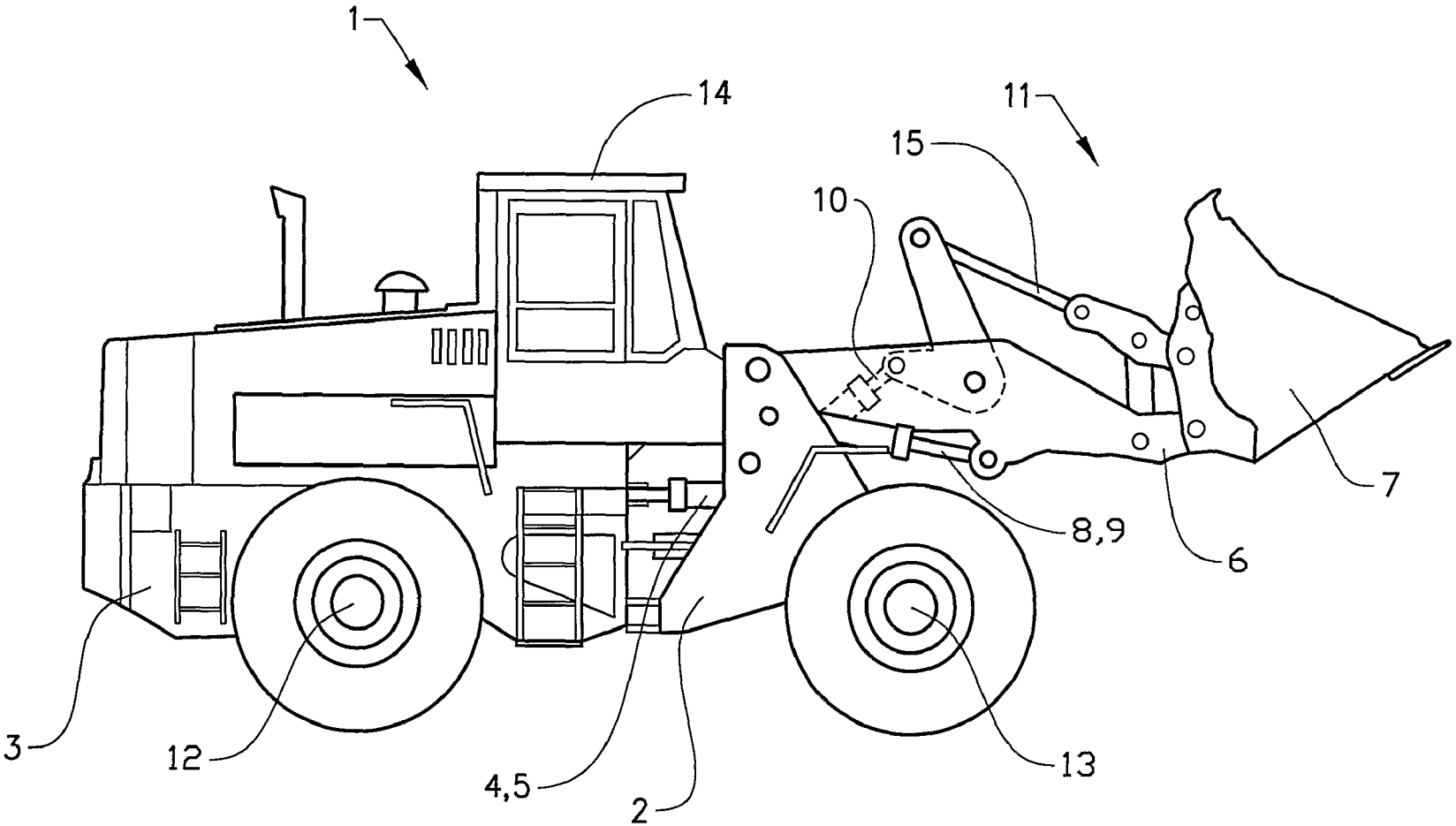

FIG. 1 shows a wheel loader 1. The body of the wheel loader 1 comprises a front body section 2 and a rear body section 3, which sections each has a pair of half shafts 12, 13. The rear body section 3 comprises a cab 14. The body sections 2, 3 are connected to each other in such a way that they can pivot in relation to each other around a vertical axis by means of two first actuators in the form of hydraulic cylinders 4, 5 arranged between the two sections. The hydraulic cylinders 4, 5 are thus arranged one on each side of a horizontal centerline of the vehicle in a vehicle traveling direction in order to turn the wheel loader 1.

The wheel loader 1 comprises an equipment 11 for handling objects or material. The equipment 11 comprises a load-arm unit 6 and an implement 7 in the form of a bucket fitted on the load-arm unit. A first end of the load-arm unit 6 is pivotally connected to the front vehicle section 2. The implement 7 is pivotally connected to a second end of the load-arm unit 6.

The load-arm unit 6 can be raised and lowered relative to the front section 2 of the vehicle by means of two second actuators in the form of two hydraulic cylinders 8, 9, each of which is connected at one end to the front vehicle section 2 and at the other end to the load-arm unit 6. The bucket 7 can be tilted relative to the load-arm unit 6 by means of a third actuator in the form of a hydraulic cylinder 10, which is connected at one end to the front vehicle section 2 and at the other end to the bucket 7 via a link-arm system 15.

Figure 2:
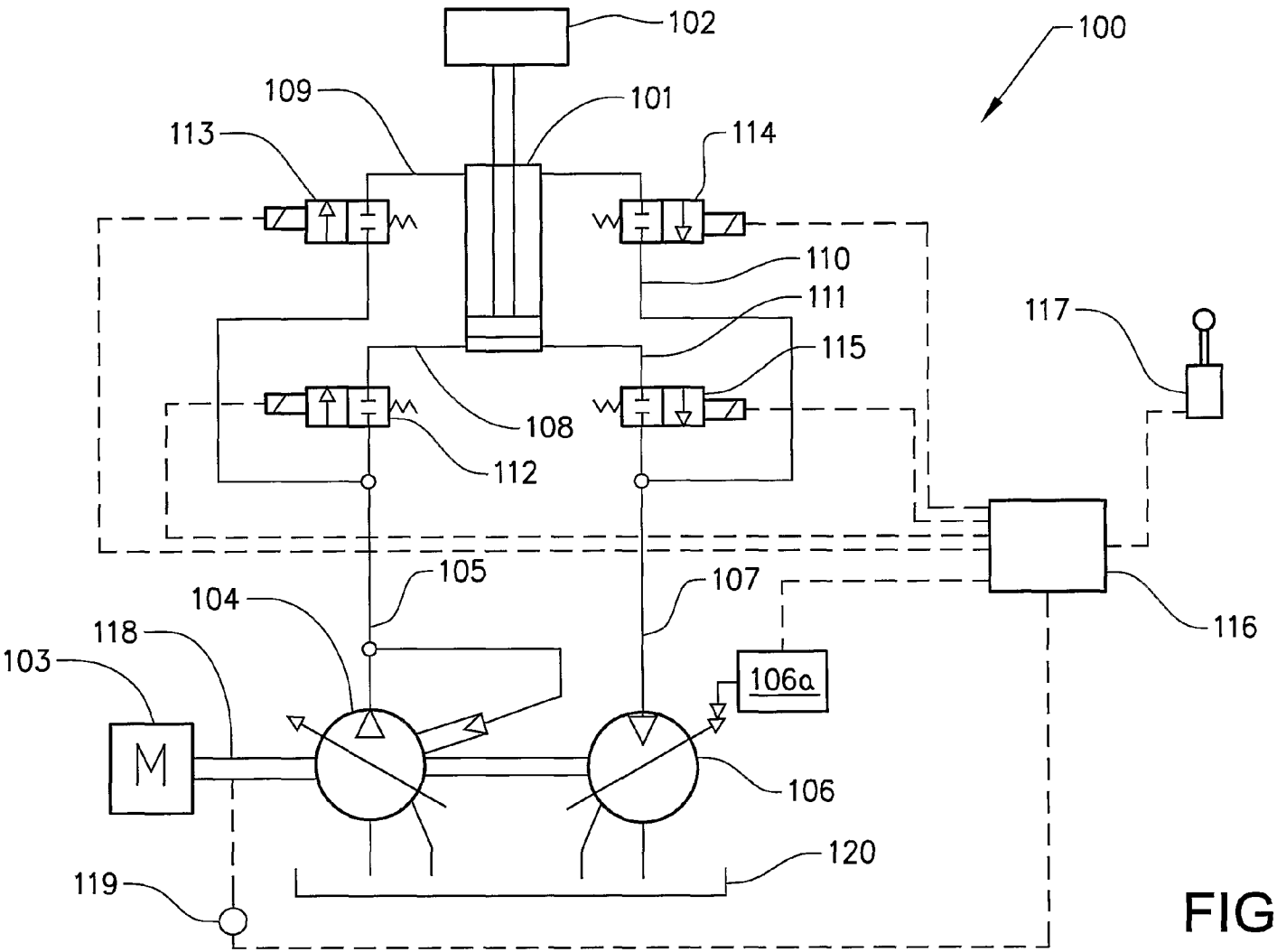
FIG. 2 shows a system principle for energy recovery in a work vehicle.

FIG. 2 shows a simplified arrangement for energy recovery in a hydraulic circuit 100 comprising a hydraulic cylinder 101 arranged for moving a load 102. The arrangement comprises a power source 103 in the form of a diesel engine for propelling the wheel loader. The arrangement further comprises a pump 104, which is rotatably driven by the power source 103.

The hydraulic cylinder 101 is arranged in fluid connection with the pump 104 via a first conduit 105. A variable displacement hydraulic motor unit 106 is arranged in fluid connection with the cylinder 101 and downstream the cylinder via a second conduit 107. Said motor unit 106 comprises a single motor. A fluid container 120 is arranged downstream of the motor 106 for collecting fluid.

The first conduit 105 is branched off in two input conduits 108, 109 to the cylinder. A first input conduit 108 is connected to a piston side and a second input conduit 109 is connected to a piston rod side. Two output conduits 110, 111 are also connected to the cylinder. A first output conduit 110 is connected to the piston rod side and a second output conduit 111 is connected to the piston side. The two output conduits 110, 111 merges to the second conduit 107.

An on/off valve 112, 113, 114, 115 is arranged on each of these four input/output conduits 108, 109, 110, 111. By simultaneously open the on/off valve 112 on the first input conduit 108 and the on/off valve 114 on the first output conduit 110, the load 102 may be raised. In the same way, by simultaneously open the on/off valve 113 on the second input conduit 109 and the on/off valve 115 on the second output conduit 111, the load 102 may be lowered.

The arrangement comprises a controller, or electronic control unit, 116, which is connected to each of the on/off valves 112, 113, 114, 115 for electrically controlling them, see dotted lines.

The arrangement further comprises a control lever, or joystick, 117 for operation by an operator. The control lever 117 is electrically connected to the controller 116. Operation of the control lever 117 generates a work function signal indicative of a requested raising or lowering of the load 102.

The variable displacement hydraulic motor 106 is arranged for controlling the speed of the movement of the load 102. Further, the fluid connection through the first conduit 105, 108, 109 from the pump 104 to the cylinder 101 is free from actuator movement controlling throttling means. The controller 116 is electrically connected to the motor 106 for adjusting the displacement according to a request from the operator via the control lever 117.

The diesel engine 103 mechanically drives the pump 104 via a drive shaft 118. The drive shaft 118 is also mechanically connected to the motor 106. Thus, the pump 104 and the motor 106 rotates at the same speed during operation. A sensor 119 senses a rotational speed of the output shaft 118 of the diesel engine. Said sensor 119 is electrically coupled to the controller 116.

An example of a method for moving the load 102 is described below;

The operator maneuvers the control lever 117 and a corresponding signal is generated with information of requested direction and speed of the load 102. The generated work function signal is received by the controller 116. If the work function signal requires a lifting of the load 102, the controller opens the on/off valve 112 on the input conduit to the piston side and the on/off valve 114 on the output conduit on the piston rod side. The other on/off valves 113, 115 remain closed.

Depending on the extent of movement of the control lever 117 from a neutral position, the work function signal received by the controller 116 also comprises information regarding the requested speed of movement of the load 102. Further, a signal indicative of the speed of the diesel engine 103 is also received by the controller 116. In response to receipt of the work function signal and the engine speed signal, the controller 116 adjusts the displacement of the motor 106. The speed of movement of the piston in the cylinder 101 and thus also the speed of movement of the load 102 is thereby controlled. The movement of the piston in the cylinder is preferably increased from a standstill according to a predetermined ramp, stored in a computer memory, to reach the final speed requested by the operator. Thus, the adjustment of the displacement of the motor 106 is performed based on information on the position of the control lever 117 and the speed of the motor 106.

By virtue of the fact that the motor 106 is rotationally coupled to the engine 103, any recovered energy in the motor 106 is transmitted back to the pump 104 and the engine 103.

Figure 3:
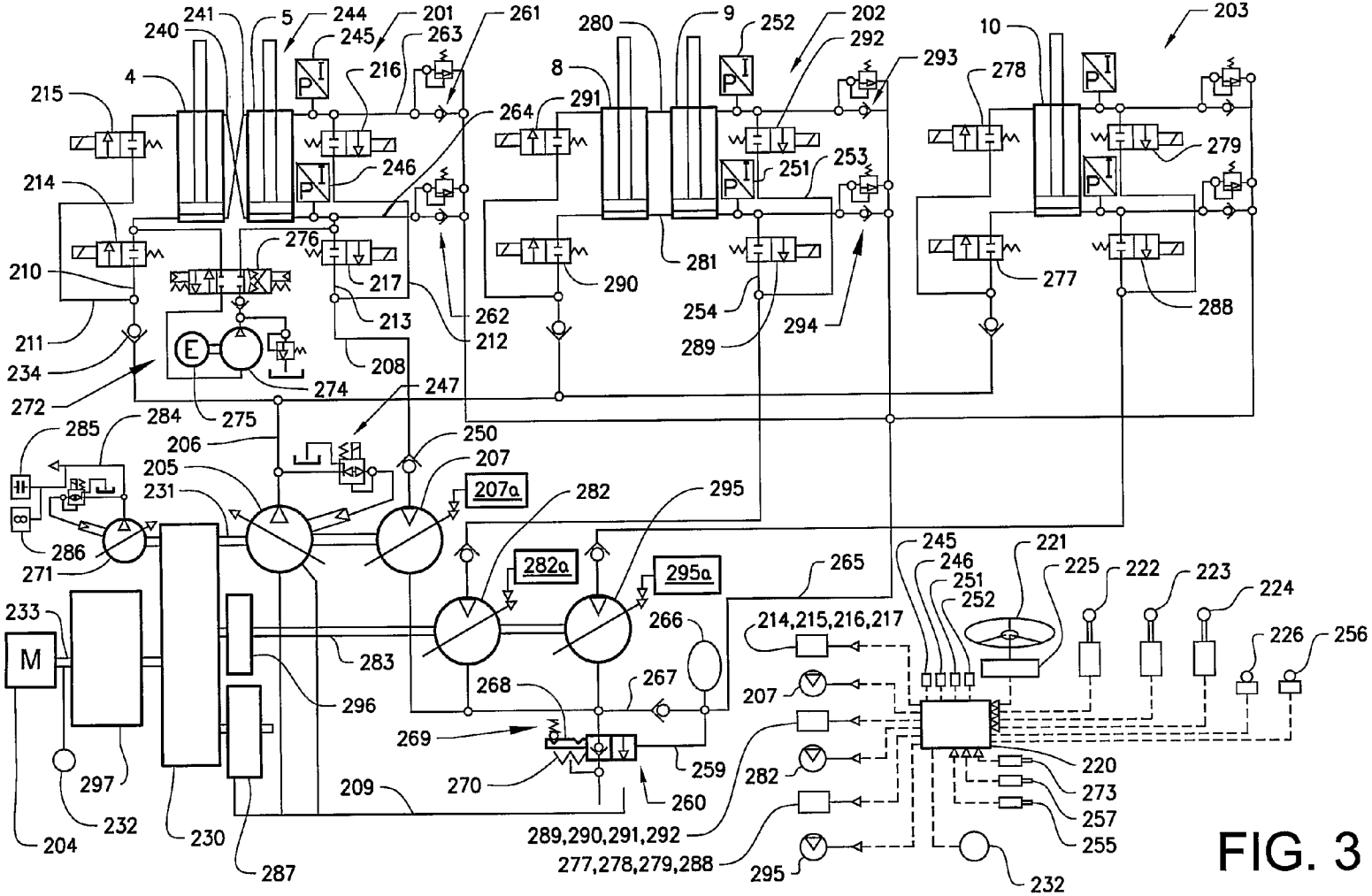
FIG. 3 shows an embodiment of an arrangement for controlling the wheel loader of FIG. 1.

FIG. 3 shows a preferred embodiment of an arrangement for controlling the wheel loader 1 of FIG. 1. A first hydraulic circuit 201 is arranged for controlling steering (turning) of the wheel loader 1 via the pair of steering cylinders 4, 5. A second hydraulic circuit 202 is arranged for lifting the load arm unit 6 via the pair of lift cylinders 8, 9. A third hydraulic circuit 203 is arranged for tilting the implement 6 via the tilt cylinder 10.

The arrangement comprises a power source 204 in the form of a diesel engine for propelling the wheel loader. The power source 204 rotationally drives a first pump 205, which is common for the first, second and third hydraulic circuits 201, 202, 203.

The variable displacement pump 104, 205 comprises a drive shaft, a rotatable cylinder barrel having multiple piston bores, pistons held against a tiltable swashplate, and a valve plate. When the swashplate is tilted relative to the longitudinal axis of the drive shaft, the pistons reciprocate within the piston bores to produce a pumping action and discharge the pressurized fluid to an outlet port. When the swashplate is positioned at the center and is not tilted, the pistons do not reciprocate and the pump does not produce any discharge pressure.

The steering cylinders 4, 5 are arranged in fluid connection with the first pump 205 via a first conduit 206. A first variable displacement hydraulic motor unit 207 is arranged in fluid connection with the steering cylinders 4, 5 and downstream the cylinders via a second conduit 208. Said first motor unit 207 comprises a single motor. A fluid container 209 is arranged downstream of the motor 207 for collecting fluid.

The variable displacement hydraulic motor 106, 207 comprises a drive shaft, a rotatable cylinder barrel having multiple piston bores, pistons held against a tiltable swashplate, and a valve plate. When the swashplate is tilted relative to the longitudinal axis of the drive shaft, the pistons reciprocate within the piston bores to produce a pumping action. The pumping action by the pistons rotates the cylinder barrel and the drive shaft, thereby providing a motor torque output when the fluid pressure at an inlet port is higher than an outlet port. When the swashplate is positioned at the center and is not tilted, the pistons do not reciprocate and the motor does not produce any output torque.

Means 106*a*, 207*a* is in operational contact with the swashplate of the associated pump for regulating the displacement. The regulating means 106*a*, 207*a* is electrically controlled by the controller 116, 220. The regulating means 106*a*, 207*a* comprises, according to one example, an electrically controlled proportional valve for effecting the swashplate with pressurized fluid and thereby moving it. The regulating means 106*a*, 207*a* further comprises an angle sensor, which is arranged to sense the position of the swashplate in order to terminate the movement of the swashplate when the desired angular position is achieved.

The first conduit 206 is branched off in two input conduits 210, 211 to the steering cylinders 4, 5. A first input conduit 210 is connected to a piston side and a second input conduit 211 is connected to a piston rod side of a first steering cylinder 4.

The two steering cylinders 4, 5 are interconnected by means of two intermediate conduits 240, 241 running crosswise. Thus, the steering cylinders 4, 5 are arranged to simultaneously move in opposite directions. A first intermediate conduit 240 connects the piston rod side of the first steering cylinder 4 with a piston side of a second steering cylinder 5. A second intermediate conduit 241 connects the piston side of the first steering cylinder 4 with the piston rod side of the second steering cylinder 5.

Two output conduits 212, 213 are connected to the second steering cylinder 5. A first output conduit 212 is connected to the piston rod side and a second output conduit 213 is connected to the piston side of the second cylinder 5. The two output conduits 212, 213 merges to the second conduit 208.

An on/off valve 214, 215, 216, 217 is arranged on each of the four input/output conduits 210, 211, 212, 213. By simultaneously open the on/off valve 214 on the first input conduit 210 and the on/off valve 217 on the second output conduit 213, the vehicle may be turned in a first direction. In the same way, by simultaneously open the on/off valve 215 on the second input conduit 211 and the on/off valve 216 on the first output conduit 212, the vehicle may be turned in a second, opposite direction.

The arrangement comprises a controller 220, which is connected to each of the on/off valves 214, 215, 216, 217 for electrically controlling them.

The arrangement comprises a first steering means in the form of a steering wheel 221 for operation by an operator. An angle sensor 225 of the steering wheel 221 is electrically connected to the controller 220. Operation of the steering wheel 221 generates a work function signal indicative of a requested steering of the vehicle.

The arrangement further comprises a second steering means in the form of a control lever, or joystick, 222 for operation by an operator. The steering control lever 222 is electrically connected to the controller 220. Operation of the control lever 222 generates a work function signal indicative of a requested steering of the vehicle.

The operator of the vehicle may choose which of the two steering means 221, 222 he prefers in a certain situation.

The variable displacement hydraulic motor 207 is arranged for controlling the speed of the movement of the steering cylinders 4, 5. Further, the fluid connection through the first conduit 206, 210, 211 from the pump 205 to the steering cylinders 4, 5 is free from actuator movement controlling throttling means. The controller 220 is electrically connected to the motor 207 for adjusting the displacement according to a request from the operator via the steering control means 221, 222.

The diesel engine 204 mechanically drives the pump 205 via a transmission 230 and a first drive shaft 231. The first drive shaft 231 is also mechanically connected to the motor 207. Thus, the pump 205 and the motor 207 rotates at the same speed during operation. A sensor 232 senses a rotational speed of an output shaft 233 of the diesel engine 204. Said sensor 232 is electrically coupled to the controller 220.

A non-return valve 234 is arranged on the first conduit 206 and functions as a load keeping valve for the steering function.

The hydraulic circuit forms a load sensing system 244. The load sensing hydraulic system 244 is characterized by that the operating condition of the load is sensed and that the output pressure of the pump 205 is controlled so that it exceeds the load pressure existing in the cylinders by a predetermined differential.

The pump 205 does not control the speed of the actuators 4, 5, but instead only supplies a specific pressure, which means that the pump needs to be informed when the pressure drops too low in the system. The pump 205 should supply sufficient pressure so that the pressure on the piston side and the piston rod side of the cylinder does not fall below a predetermined level (for example 10 bar). A certain pressure (for example 10 bar) is required in the system also when no functions are used in order to lubricate the pump 205.

Means 245, 246 are therefore provided for sensing a load pressure subjected to the cylinders 4, 5 during operation. Said sensing means is formed by electrical pressure sensors 245, 246, which generate pressure signals to the controller 220.

Further, an electrically controlled pressure reducing valve 247 is arranged in connection to the pump 205 for regulating the output pressure of the pump. The pressure reducing valve 247 is arranged on a side conduit between the first conduit 206 and the displacement control means of the pump 205 for regulating a fluid connection between the first conduit and the pump. In other words, the pressure reducing valve 247 is adapted to send a hydraulic LS signal to the pump 205 depending on a signal from the controller 220. Thus, the signal from the controller may be dependent or independent of the pressure level sensed by the pressure sensors 245, 246.

Thus, during operation, the controller 220 receives information that the operator control means 221 or 222 is activated, and of the pressure levels of the pressure sensors 245, 246. The controller 220 thereafter controls the output pressure of the pump 205 by sending a corresponding signal to the pressure reducing valve 247.

For a smooth start of a function, the variable displacement motor 207 is designed to have a capability to function when the swashplate is tilted somewhat in the opposite direction relative to the longitudinal axis of the drive shaft. Such a swashplate position is often referred to as an "over-center" position. When the swashplate is tilted somewhat to the over-center position, the motor 207 will have a small pumping function. The pumped flow will leak into the motor house and further to tank 209. The motor 207 should be designed so that the pressure generated in the "over center" position is on a controlled, small level (for example 10 bar). A non-return valve 250 is arranged on the second conduit 208 upstream of the motor 207 in order to prevent that the function is run in the wrong direction. When a work function is started, the outlet on/off valve 216, 217 in question, is fully opened. The motor is thus initially in the "over center" position. The controller 220 controls the displacement of the motor 207 and the swash plate of the motor is then moved from the "over center" position, over the neutral, center position to the requested position for controlling the speed of the cylinders 4, 5.

Further, in some load cases, there is a requirement to aid to after-fill the cylinders when the pump 205 cannot supply the desired fluid flow. A two position backup valve 260 is arranged downstream of the motor 207. Further, a non-return valve 261, 262 is arranged on an outlet conduit 263, 264 connected to the piston rod side and the piston side, respectively, of the cylinder. These outlet conduits 263, 264 merge to a common conduit 265 connected to the motor 207 downstream of the motor 207, bypassing the backup valve 260. A pilot pressure conduit 259 is connected to the common conduit 265 and to a pilot pressure side of the backup valve 260 for acting on the backup valve with a pilot pressure. In this way, the backup valve may block the fluid connection from the motor 207 to the tank 209 and the fluid will therefore flow back to the cylinder via a conduit 267 bypassing the backup valve 260, via the common conduit 265 and the outlet conduit 263, 264.

The backup valve 260 is arranged to be closed when there is a need to after-fill the cylinders and be open when no after-fill is needed. A rod 268 is connected to one side of the backup valve 260 opposite the pilot pressure side. The rod 268 has two grooves at a distance from each other, defining the two positions of the backup valve 260. A spring loaded ball 269 is adapted to be received in one of said grooves at a time. Further, the backup valve 260 is spring loaded via a spring 270.

An accumulator 266 is in fluid connection with the common conduit 265, which extends between the motor 207 and the outlet side of the second cylinder 5. The accumulator 266 is arranged in such a way that the backup valve 260 will not be moved too frequently. Thus, it extends the life of the backup valve. When the accumulator 266 is charged to a certain level, the backup valve 260 will open completely and there will be no pressure drop over the valve. When the pressure of the accumulator 266 falls to a certain level, the backup valve will close again and the accumulator 266 will be recharged. When there is no need to after-fill the cylinder, the accumulator will provide a sufficient pressure in order to keep the backup valve in the open position and thereby not generate any pressure drop. The backup valve 260 is required to have a certain hysteresis. The backup valve 260 is designed to close at a low pressure level (for example 4 bar) and open at a higher pressure level (for example 8 bar).

The function of backup valve 260 system described above is not only applicable when the pump cannot supply the desired fluid flow to the cylinder. It is also applicable for example when the load arm unit 6 is lowered or when the bucket 7 is emptied and the movement is performed totally by the action of the gravity force. The inlet side of the cylinder may in this case be closed and the pump may be used for other purposes.

A method for prevention of stalling a function will be described in the following. In case the pump 205 reaches its maximum pressure level and does not have the power to move the cylinder, the displacement of the motor 207 needs to be adjusted down. Further, the displacement of the motor 207 needs to be adjusted down when the motor has a higher speed than the cylinder at the same time as the cylinder has a higher speed than the pump, which may take place for example during lowering of an empty bucket. The stalling may be prevented in that the controller 220 receives pressure signals from the pressure sensors 245, 246 on the outlet conduits 212, 213 from the piston side and the piston rod side of the cylinder. The motor 207 is adjusted down if the detected pressure is below a predetermined level. If this adjustment method is not sufficient, the fluid will be regenerated via the after-fill system described above.

As an alternative or complement to the stalling prevention method described above, electrically operated pressure sensors may be arranged on the inlet conduits 210, 211 of the cylinder. The controller 220 will receive pressure signals from these inlet pressure sensors and can adjust the displacement of the motor down. In this way, the problem of the case that the pump cannot reach maximum pressure is solved.

The steering function is preferably prioritized relative to other work functions like lifting and tilting so that the steering capacity is guaranteed when the hydraulic system cannot fulfill all required work functions to the requested degree. The controller 220 is programmed for executing this prioritizing function.

According to one prioritizing method, the engine speed is detected, for example via the sensor 232, and a maximum pump flow is calculated based on the detected engine speed. Further, the controller receives information from the steering means 221, 222 regarding a required steering speed from the operator. The other work functions, like lifting and tilting, is then depressed to such an extent that the steering cylinders 4, 5 receives the power necessary for steering the vehicle.

The arrangement further comprises an auxiliary circuit 272 for controlling the steering function when a failure in the arrangement hinders steering control via the first circuit 201. The auxiliary circuit 272 comprises an auxiliary pump 274 and an electric motor 275 driving the auxiliary pump 274. The auxiliary pump 274 is connected to the input conduit 210 on the piston side of the first steering cylinder 4 and to the output conduit 213 on the piston side of the second steering cylinder 5 via an electrically controlled three position directional valve 276. The directional valve may be either of an on/off type or of a continuously variable type.

Means 273 is arranged to sense a relative angle between the forward vehicle section 2 and the rear vehicle section 3. The sensor 273 is electrically coupled to the controller 220. Thus, the controller 220 receives information about the relative position of the two vehicle sections.

When the operator has requested turning of the vehicle via the steering means 221 or 222 and no relative movement of the two vehicle sections is detected, the controller activates the auxiliary steering control circuit 272. A process for the further operation of the auxiliary circuit will be described below.

All on/off valves 214, 215, 216, 217 are closed and the displacement of the hydraulic motor 207 is adjusted down to zero. In this way, any oil leakage from the auxiliary pump 274 is prevented. The controller 220 actuates the electric motor 275, which in turn drives the auxiliary pump 274. The steering of the steering cylinders 4, 5 is performed by controlling the position of the directional valve 276.

In certain cases, it is desired not to actuate the auxiliary steering system 272. The auxiliary steering system 272 is not actuated when the controller 220 registers that the requested relative movement does not take place between the forward and the rear vehicle sections 2, 3 and simultaneously receives information from the pressure sensor 245, 246 that the steering cylinder input pressure equals the delivered pump pressure.

During operation, the motor 207 will recover any excess energy from the steering function and transmit this energy to the engine 204. This recovered energy may be used by the engine 204 to drive other systems, like the vehicle driveline 287 and service brakes 285, and components like fans 286, generators etc, via a branch line 284. A second pump 271 is arranged for supplying the components 285, 286 with pressurized fluid and is rotationally driven by the engine 204 via the transmission 230.

Turning now to the second hydraulic circuit 202 arranged for lifting the load arm unit 6 via the pair of lift cylinders 8, 9. The arrangement and function of the second hydraulic circuit 202 is similar to the first hydraulic circuit 201 for the steering function. Therefore, in the following, only the main differences will be pointed out.

The lift cylinders 8, 9 are arranged to simultaneously move in the same direction. The lift cylinders 8, 9 are interconnected by means of two intermediate conduits 280, 281. A first intermediate conduit 280 connects the piston rod sides of the cylinders 8, 9 and a second intermediate conduit 281 connects the piston sides of the cylinders 8, 9. The second hydraulic circuit 202 comprises a pair of inlet on/off valves 290, 291 and a pair of outlet on/off valves 292, 289 arranged in the same way as the on/off valves of the first hydraulic circuit 201.

The pump 205 is common for the steering cylinders 4, 5 and the lift cylinders 8, 9. A second hydraulic variable displacement motor unit 282 is in fluid connection with the lift cylinders 8, 9 downstream of the lift cylinders 8, 9. Said second motor unit 282 comprises a single motor. Also the second variable displacement motor 282 is arranged for a rotation connection to the engine 204 in order to transmit energy to the engine. The second motor 282 is arranged on a separate drive shaft 283. Also the second motor 282 has electrically controlled means 282*a* for regulating the displacement.

The arrangement comprises a lifting control means 223, in the form of a control lever, for operation by an operator. The lifting control means 223 is electrically connected to the controller 220. Operation of the lifting control means 223 generates a work function signal indicative of a requested lifting of the load-arm unit 6.

The recovery of energy when the load arm unit 6 is lowered will be described below. The motor 282 will recover energy from the load arm unit and the load and transmit this energy to the engine 204. This recovered, excess energy may be used by the engine 204 to drive other systems, like the vehicle driveline 287 and service brakes 285, and components like fans 286, generators etc, via the branch line 284.

According to one example of a control strategy for recovery of energy during said lowering of the load-arm unit, the pump 205 is disconnected from fluid connection with the cylinders 8, 9 via the inlet on/off valves 290, 291. The pump 205 may during this lowering operation be used for other functions/purposes. The weight of the load-arm unit 6 (and any load on the implement 7) drives the lowering movement of the load-arm unit and the speed is controlled by the controller 220 via the motor 282. The controller 220 will register if the motor speed increases more than the load speed by recording the pressure on the outlet side of the cylinders. If so, the controller 220 adjusts the motor 282 down so that it gets in contact with the load again.

The second hydraulic circuit 202 may be designed in different ways. According to a first example, the on/off valve 292 on the outlet conduit from the piston rod side of the cylinder 9 is closed during said lowering operation. All fluid from the outlet on the piston side of cylinder 9 is then transferred to the tank 209 via the motor 282. This first example requires a motor with a capacity to handle large flows.

According to a second example, the on/off valve 292 on the outlet conduit from the piston rod side of the cylinder 9 is open during said lowering operation. A part of the hydraulic fluid flow from the piston side of the second steering cylinder 5 is then guided to the piston rod side of the second steering cylinder 5. More specifically, only a fluid volume corresponding to the piston rod area is transferred to the tank 209 via the motor 282. This second example requires a motor which do not need to handle very large flows, but instead needs a capacity to handle a high fluid pressure. If the piston rod area is 70% of the piston area, this means that the motor 282 can have a 70% less displacement, but instead be subjected to a pressure which is 70% higher. A critical part is how the pump 205 is actuated when there is a need for actuation of the pump. An exemplary method for connecting the pump is described below;

When the load does not keep up with the speed of the motor 282, the motor will be adjusted down so that there is always a contact with the load. When the cylinder speed is too low, the pump 205 is actuated. This is accomplished in the following way; The displacement of the motor 282 is increased for a short period of time when the motor 282 has been adjusted down to a predetermined level. The motor will then speed up to the same speed as the load for a short moment and the cylinders 8, 9 will be supplied with fluid via after-fill valves 293, 294. The fluid flow generated by the displacement increase of the motor 282 corresponds to the flow supplied by the piston side of the cylinder in that moment. The outlet on/off valve 292 on the piston rod side will be closed when the displacement increase is finished and the pump is connected to the cylinder via the inlet on/off valve 291 on the piston rod side. Further control of the function speed can now continue via the motor 282.

The pump 205 does not control the speed of the actuators 4, 5, but instead only supplies a specific pressure, which means that the pump needs to be informed when the pressure drops too low in the system. Regarding the lift cylinders 8, 9, the lowest pressure arises on the piston rod side, i.e the pump side, when a heavy load drives the pump (for example when the implement is lowered). Further, in case the pump 205 needs to force the load arm unit downwards in order to lower the implement, the lowest pressure arises on the piston side, i.e the outlet side.

Further, an automated process for returning the bucket 7 to a predetermined, low position from a raised position is achieved by the second hydraulic circuit 202. This automated process is generally referred to as return to dig (RTD). The RTD function is automatically performed when an operator actuates a control means 226, preferably in the form of a button, which is electrically coupled to the controller 220.

The arrangement comprises means 257 for determining an angular position of the load-arm unit 6 relative to the front vehicle section 2. Pressure sensors 251, 252 are arranged on the output conduits 253, 254 of the lift cylinders 8, 9 to sense the weight of the load. The pressure sensors 251, 252 are electrically coupled to the controller 220.

Said angle determining means 257 is electrically coupled to the controller 220 and may be formed by an angular sensor arranged at the joint between the load-arm unit 6 and the forward vehicle section 2. As an alternative, the angle determining means 257 may be formed by a sensor arranged to sense the extension of the lifting cylinder 8, 9.

One example of the automated RTD process will now be described. The controller 220 receives a signal from the RTD control means 226 that said RTD is requested by the operator. The controller further continuously receives information about the angular position of the load-arm unit 6 from the sensor 257. The load-arm unit 6 is lowered towards the ground from the raised, initial position by actuation of the lifting cylinders 8, 9 and when it has reached a certain intermediate position, its motion is braked via adjusting the displacement of the second hydraulic motor 282 down until the load-arm unit 6 reaches the predetermined, lower dig position. The controller 220 calculates a brake distance depending on certain operating conditions. Further, the controller 220 can then based on the brake distance and the predetermined dig position determine said certain intermediate position, at which the braking should be initiated. Further, the extent of adjustment of the hydraulic motor displacement depends on the engine speed, which is sensed by said engine speed sensor 232.

Further, as a complement to the described RTD process, the arrangement comprises means 255 for determining an angular position of the bucket 7 relative to the load-arm unit 6. Said angle determining means 255 is electrically coupled to the controller 220 and may be formed by an angular sensor arranged at the joint between the load-arm unit 6 and the bucket 7. As an alternative, the angle determining means 255 may be formed by a sensor arranged to sense the extension of the tilting cylinder 10. If the controller receives information from the bucket angle sensor 255 that the bucket is tilted downwards to a certain, predetermined extent when the RTD process is initiated, the bucket is automatically tilted up to a predetermined neutral position, in which it is substantially level with the ground when the predetermined, low dig position is reached.

Turning now to the third hydraulic circuit 203 arranged for tilting the bucket 7 via the tilt cylinder 10. The arrangement and function of the third hydraulic circuit 203 is similar to the first and second hydraulic circuits 201, 202. Therefore, in the following, only the main differences will be pointed out.

The pump 205 is common for the steering cylinders 4, 5, the lift cylinders 8, 9 and the tilt cylinder 10. A third hydraulic variable displacement motor unit 295 is in fluid connection with the tilt cylinder 10 downstream of the tilt cylinder 10. Said third motor unit 295 comprises a single motor. Also the third variable displacement motor 295 is arranged for a rotation connection to the engine 204 in order to transmit energy to the engine. The third motor 295 is drivingly arranged on the same drive shaft 283 as the second motor 282. Also the third motor 295 has electrically controlled means 295*a* for regulating the displacement.

The third hydraulic circuit 203 comprises a pair of inlet on/off valves 277, 278 and a pair of outlet on/off valves 279, 288 arranged in the same way as the on/off valves of the first and second hydraulic circuit 201.

The arrangement comprises a tilting control means 224, in the form of a control lever, for operation by an operator. The tilting control means 224 is electrically connected to the controller 220. Operation of the tilting control means 224 generates a work function signal indicative of a requested tilting of the bucket 7.

Further, an automated process for shaking the bucket 7 free of debris etc is achieved by the third hydraulic circuit 203. This automated process is generally referred to as bucket shakeout. The RTD function is automatically performed when an operator actuates a control means 256, preferably in the form of a button, which is electrically coupled to the controller 220. The controller 220 controls a high, preferably maximum, LS pressure to the pump 205 via the pressure reducing valve 247. The controller 220 adjusts the displacement of the hydraulic motor 295 to a certain extent. The controller 220 further controls opening and closing of the on/off valves 277, 278, 279, 288 to a certain amplitude and with a certain frequency for shaking the bucket 7 back and forth. A frequency in the interval 5-15 Hz is preferable. The pump displacement will not be regulated down at this magnitude of frequency and the displacement of the hydraulic motor 295 is controlled to be positive during the bucket shakeout.

A coupling means 296 is arranged between the engine 204 and the second and third motor 282, 295 for disconnecting the motors from a driving connection with the engine. More specifically, the coupling means 296 is arranged on the common drive shaft 283 between the motors 282, 295 and the transmission 230. The coupling means 296 is formed by a hydraulic disc clutch. Drag losses in the motors 282, 295, which may arise due to the fact that the motors are rotated, are eliminated by disconnecting the motors. During a transport mode, i.e when the vehicle is transported a longer stretch, the second and third hydraulic circuits 202, 203 for the work functions lifting and tilting are normally not in use. Thus, the coupling means 296 is controlled to disconnect the motors 282, 295 during the transport mode.

The disconnection of the second and third motor 282, 295 via the coupling means 296 may be performed in different ways; manually, automatically when the vehicle reaches a predetermined speed (corresponding to transport mode, for example 25 km/h) , automatically after a predetermined time period has elapsed since it was last actuated, automatically due to certain operation characteristics (like vehicle speed, engine number of revolutions, selected gear, actuation of other function (s) etc).

As an alternative to a hydraulic disc clutch, the coupling means 296 is formed by a freewheel. Further, the clutch means may be built-in in the respective hydraulic motor 282, 295.

A generator 297 is rotationally connected to the engine 204. In the shown example in FIG. 4, the generator 297 is connected on the output shaft 233 from the engine 204, between the engine 204 and the transmission 230. The recovered energy from the motor (s) 207, 282, 295 may be stored in the generator 297. As an alternative, a battery (not shown) is connected to the generator 297.

The battery may in turn be connected to a further energy consumer. The generator 297 may further be used as a motor and regenerate energy from the battery.

The wheels of the wheel loader 1 are driven by the half shafts 12, 13, see FIG. 1, which in turn are driven by the engine 204 via the driveline in a per se known way. A converter 287 in the driveline is indicated in FIG. 3. The converter 287 is driven by the engine 204 via the transmission 230. Any recovered energy in the hydraulic motors 207, 282, 295 may be used for propelling the vehicle via the converter 287.

A power output of the hydraulic functions is controlled according to a further process. More specifically, a maximum available power output is limited for the hydraulic functions in certain situations. For example, when the engine 204 has a low speed and the driveline requires a high power output, the maximum available power output for the hydraulic functions is temporarily limited. The hydraulic power is determined by multiplying pressure with flow. The controller 220 determines if there is a requirement to limit the hydraulic power output and to what extent the hydraulic power output should be limited. The pressure is determined by means of said pressure sensors and a total available flow output is calculated. The flow is determined by means of the displacement position of the hydraulic motors 207, 282, 295 and the engine speed. The limitation of the hydraulic power output may be accomplished by limiting the displacement of the hydraulic motors 207, 282, 295.

According to an alternative to calculating a total available flow, the controller 220 continuously monitors the requirement of driveline power and continuously increase, or decrease, respectively the total flow so that the engine 204 works properly and does not come to an undesired standstill. Further, the maximum available hydraulic power may be prioritized differently for different work functions.

A maximum available actuator force is limited according to a further method example. By limiting the maximum available actuator force, the movement of the actuator will be stopped when the counterforce is above a predetermined force. Thus, the actuator pressure is sensed and when the sensed pressure reaches a specific predetermined maximum level, the displacement of the hydraulic motor is decreased to such an extent that the speed of the actuator (and the load) is decreased to zero. According to a first alternative, the specific predetermined maximum pressure level is selected by the operator. According to a second alternative, the specific predetermined maximum pressure level is automatically selected depending on a current operation mode of the vehicle. The current operation mode of the vehicle is determined by the controller 220 based on other operation parameters, which the controller has access to.

According to a further process example, a maximum available power output of the hydraulic functions is controlled based on a temperature in the hydraulic system. Preferably, the maximum available power output of the hydraulic system is determined as a function of the temperature. According to a first alternative, a maximum temperature is predetermined, for example 95 degrees Celsius. The maximum available power output of the hydraulic system is proportionally limited when a sensed temperature exceeds the predetermined maximum temperature. According to a second alternative, a minimum temperature is predetermined and the maximum available power output of the hydraulic system is proportionally limited when a sensed temperature is below the predetermined maximum temperature. The method for controlling the maximum available power output of the hydraulic system is the same as has been described above for the case that the engine speed gets too low.

Figure 4:
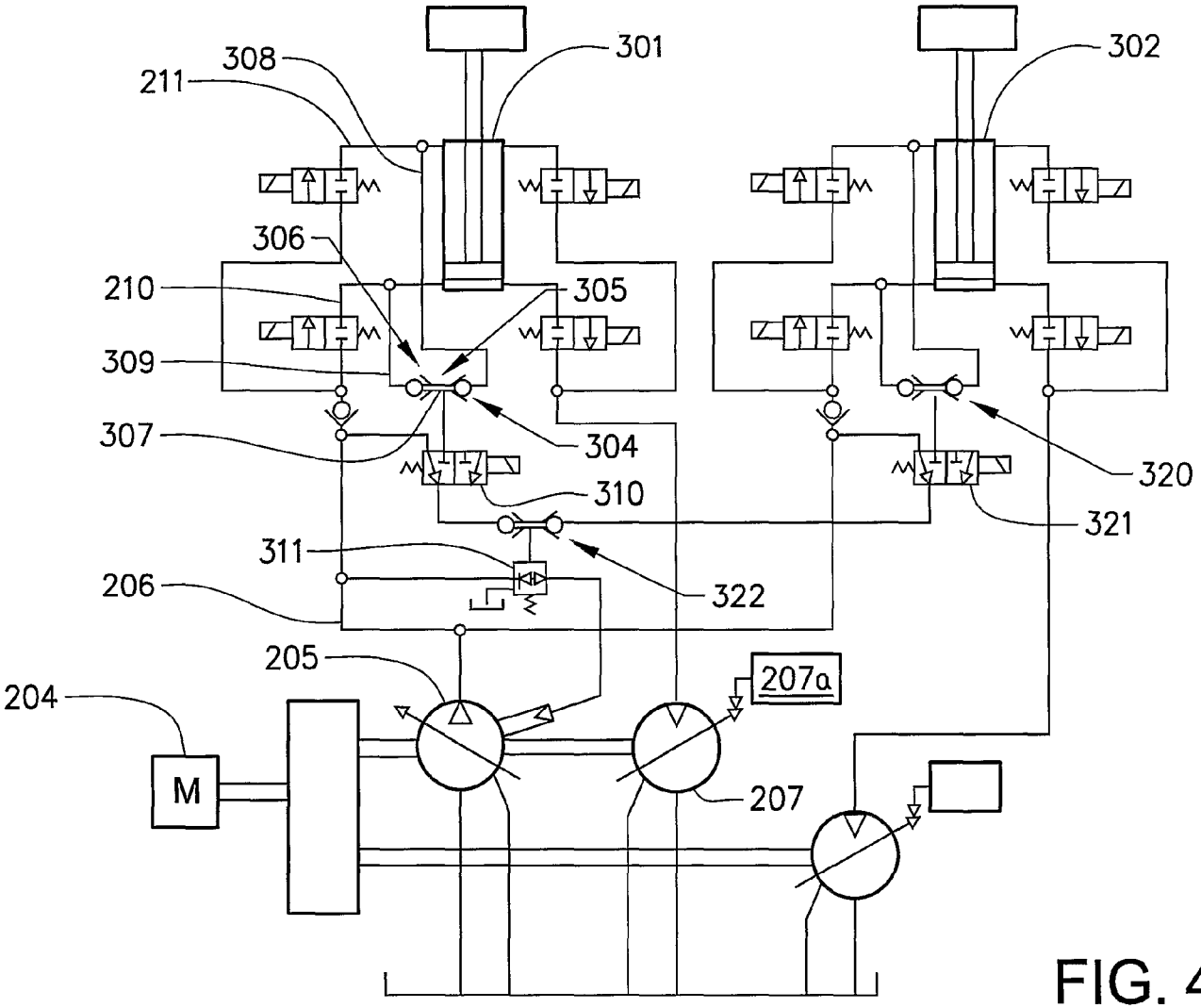
FIG. 4 illustrates an alternative LS-system relative to the embodiment of FIG. 3.

FIG. 4 illustrates an alternative and simplified hydraulic LS-system relative to the embodiment shown in FIG. 3. Only the features relating to the alternative LS system will be described below. For ease of presentation, the pair of steering cylinders 4, 5 of FIG. 3 are here replaced by one single cylinder 301. The pair of lifting cylinders 8, 9 of FIG. 3 are likewise replaced by one single cylinder 302.

A circuit branch 304 is arranged for determining which side of the hydraulic cylinder 301 has the highest pressure level. The balls of two inverse shuttle valves 305, 306 are mechanically rigid connected to each other via a rod 307. The input pressures to the cylinder 301 acts on each ball via a conduit 308, 309 connected to the first and second input conduits 210, 211, respectively.

In this way, the lowest fluid pressure existing at the inlet ports of the cylinder 301 is directed to an electrically controlled directional valve 310.

A similar LS circuit branch 320 as described for the steering function is arranged for the lift function.

The two directional valves 310, 321 of the two circuit branches are each in fluid connection with the first conduit 206. The two directional valves 310, 321 are connected to each other via a further pair of inversely arranged shuttle valves 322, with a similar design as described above, for controlling a further control valve 311, which in turn is arranged to control the output pressure of the pump 205.

The work vehicle may have a hydrostatic transmission. In such a case, the recovered energy may also be used by the engine 204 to drive pumps or other components in the hydrostatic transmission.

Further, thanks to the invention, conditions are created for integration of pump functions of different systems in the vehicle.

According to a first example, the vehicle is equipped with a hydrostatic transmission. The hydrostatic transmission may comprise two pumps. These pumps may partly be used for work functions like lift, tilt and auxiliary functions. These work functions do not need high flows when the vehicle is driven with high speed, which means that the pumps can be used for propelling the vehicle. Instead, said work functions require larger flows at lower vehicle speeds, when the hydrostatic transmission does not require large flows. Thus, the pump flow requirements of said work functions and the hydrostatic transmission complement each other. In the case that the hydrostatic transmission only has one pump, it may also be used for both the hydrostatic transmission and to said work functions. In the latter case, each system needs to be able to manage the maximum pressure level of the other system.

The further pump 271, see FIG. 3, for supplying the cooling fan of the vehicle engine 204 and/or for a vehicle service brake system is in driving connection with the engine 204. According to a second example of pump integration, said pump 271 may be used for the work functions steering, lifting and/or tilting. This further pump 271 could be connected shorter times to the work functions to add pump power when there is a need for it.

The controller 116, 220 comprises a memory, which in turn comprises a computer program with computer program segments, or a program code, for implementing the control method when the program is run. This computer program can be transmitted to the controller in various ways via a transmission signal, for example by downloading from another computer, via wire and/or wirelessly, or by installation in a memory circuit. In particular, the transmission signal can be transmitted via the Internet.

The invention also relates to a computer program product comprising computer program segments stored on a computer-readable means for implementing the measurement method when the program is run. The computer program product can comprise, for example, a diskette or a CD.

The invention is not in any way limited to the above described embodiments, instead a number of alternatives and modifications are possible without departing from the scope of the following claims.

As an alternative to the RTD control button 226, the RTD actuation may be initiated by other means. For example, the lift lever 223 may be used for initiating the RTD process. Movement of the lift lever 223 to an end position of its movement range may initiate the RTD function. The lift lever 223 may for example be locked in its end position by means of an electrically controlled magnet or similar and automatically released, and returned to a neutral position, when the implement reaches the predefined lower position.

As an alternative to the position shown in FIG. 3, the sensor 232 may be arranged in another position, for example in the transmission 230. The purpose of the sensor 232 is to determine the speed of the shaft, on which the respective hydraulic motor is rotationally coupled. In case the sensor 232 senses the rotation of a drive shaft/rotating element (like a cog wheel in the transmission) rotating with a different speed than the motor shaft, the controller 220 calculates the actual speed of the motor shaft.

One of said work functions could be to rotate an upper section of the vehicle in relation to a lower section of the vehicle. This is a commonly used arrangement for excavators, where the upper section comprises a cab and the lower section comprises ground engaging members, like tracks or wheels. The actuator is in this case formed by a hydraulic motor.

According to an alternative control method of the LS system, the speed of the actuator, i.e the speed of the load, is controlled by the controller 220 adjusting the displacement of the associated motor only depending on the position of the control lever for the work function in question.

According to an alternative arrangement, an open center system is used instead of the LS system. The load speed will normally be decreased for a higher load pressure in response to a certain position of the work function control lever. Thus, a heavier load would make the actuator move more slowly. According to an alternative control method for such an open center system, the cylinder pressure is detected by means of the pressure sensors for the cylinder in question, the work function control lever position is detected and the displacement of the associated hydraulic motor is controlled based on both the detected cylinder pressure and the control lever position.

As an alternative to the arrangement of the second and third hydraulic motors 282, 295 on the common drive shaft 283, see FIG. 3, the two motors may be arranged on different drive shafts.

According to one alternative of the above described embodiment, in which a common pump is used for all work functions, one pump may be used for each work function.

According to an alternative to using only one motor 106, 207, 282, 295 for each work function, the term motor unit comprises a plurality of motors. The plurality of motors in a single motor unit may be arranged in series on a common drive shaft. The plurality of motors in a single motor unit are further arranged in parallel with respect to a fluid connection to the associated actuator so that at least one of the motors in the motor unit may be disconnected from fluid connection with the associated actuator.

Further, since hydraulic motors have drag losses, it is desired to use as small motors as possible. Therefore, according to an alternative to the specific conduit arrangement connecting the pair of steering cylinders 4, 5 in FIG. 3, only the second steering cylinder 5 is connected to the motor. More specifically, the outlet piston side of the second steering cylinder 5 is connected to the motor. The piston rod side of the first steering cylinder 4 is coupled to tank via a valve. According to a variant of this alternative, the piston rod side of the first steering cylinder 4 is connected to the motor, while the piston side of the second steering cylinder 5 is connected to tank.

Each of the variable displacement hydraulic motors 106, 207, 282, 295 is arranged for controlling the movement of the associated actuator independent of which operation mode is used, according to the above described embodiments of the invention. Thus, the hydraulic motor is not only arranged as an alternative control means for actuation in specific operation modes, like an energy recovery mode, but is instead used continuously for all operation modes during operation. In other words, as soon as the associated actuator is activated, the speed of the actuator movements will be controlled via the hydraulic motor unit.

The above described technique with a separate motor unit for controlling the speed of the cylinder (s) for each work function may be combined with the known art in that for a specific work function, for example tilt, a control valve unit is arranged upstream of the tilt cylinder for controlling its motions while for another work function, for example lift, a hydraulic motor is arranged downstream of the lift cylinders for controlling their motions. A common pump may still be used for supplying both the tilt and lift cylinders with pressurized hydraulic fluid.

With reference to the last paragraph, the after-fill system described above, see backup valve 260 in FIG. 3, may also be used for after filling the cylinder (s) which are controlled in a different way, for example by a control valve unit upstream of the cylinders. The two position backup valve is in this case arranged downstream of the cylinder (s) in a similar way as has been described above.

Further, the above described technique with a motor unit for controlling the speed of the cylinder (s) for each work function may be combined with the known art in that for a specific work function, for example lift, a valve unit is arranged upstream of the lift cylinders for controlling its motions in addition to that a hydraulic motor is arranged downstream of the lift cylinders for controlling their motions. The way to control the movement of the cylinder (s) may according to such a solution be selected. For example, for a first specific vehicle operation mode, the control valve is selected for controlling the cylinder (s) and for a second specific vehicle operation mode, the hydraulic motor is selected for controlling the cylinder (s). For example in a transport mode, when the vehicle is moved longer distances and the hydraulic system is not used at all or at not very frequently, the control valve is selected to control the cylinder (s). Instead, in a material handling mode, when the hydraulic system is used frequently, the hydraulic motor is selected to control the cylinder(s). In this way, drag losses from the motor may be decreased in the transport mode.

According to a further alternative, two work functions, for example lift and tilt, may be connected to a common hydraulic motor via a valve unit. When a first of the work functions is used, the motor is connected to the associated first work function cylinder (s) via the valve unit. When the other work function is used, the motor is connected to the associated second work function cylinder (s) via the valve unit.

The invention claimed is:

1. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the motor unit is arranged for a rotation connection to the power source in order to transmit energy to the power source.

2. A control arrangement according to claim 1, wherein the arrangement comprises means for electrically controlling displacement of the variable displacement motor unit.

3. A control arrangement according claim 1, wherein the power source is connected to at least one further energy using component in the vehicle such that energy recovered by the motor unit may be transmitted to the at least one component.

4. A control arrangement according to claim 1, wherein the arrangement comprises at least one means for storing energy recovered by the motor unit.

5. A control arrangement according to claim 1, wherein the arrangement comprises means for disconnecting a rotation connection between the power source and the motor unit.

6. A control arrangement according to claim 1, wherein the arrangement comprises a plurality of hydraulic circuits with a common pump driven by the power source.

7. A control arrangement according to claim 1, wherein the arrangement comprises operator maneuverable means for generating a work function signal.

8. A control arrangement according to claim 1, wherein the power source is formed by an internal combustion engine arranged for propelling the work vehicle.

9. A control arrangement according to claim 1, wherein the second conduit is arranged for guiding substantially all fluid from the actuator to the associated motor unit.

10. A control arrangement according to claim 1, the arrangement comprises means for sensing a load pressure subjected to the actuator during operation.

11. A work vehicle, wherein it comprises a control arrangement according to claim 1.

12. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function.

13. A control arrangement according to claim 12, wherein at least one of the hydraulic actuators is formed by a hydraulic cylinder.

14. A control arrangement according to claim 12, wherein the arrangement comprises a set of on/off valves arranged on the first and second conduit for actuating the associated hydraulic actuator.

15. A control arrangement according to claim 14, wherein the arrangement comprises means for electrically controlling the on/off valves.

16. A control arrangement according to claim 12, wherein the arrangement comprises a means for sensing a rotational speed of the power source.

17. A control arrangement according to claim 16, wherein the arrangement comprises means for controlling an output pressure of the pump so that it exceeds the sensed load pressure existing in the actuator by a predetermined differential.

18. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the pump and the motor unit are coupled in such a way to the power source that they rotate at the same speed.

19. A method for controlling a work vehicle, comprising steps of receiving a work function operator signal from an operator of the vehicle, and depending on a requested work function in the operator signal, adjusting a displacement of a variable displacement hydraulic motor unit arranged downstream of a hydraulic actuator, which is arranged for performing the work function, for controlling movements of the actuator, and transmitting energy from the motor unit via a rotation connection to a power source.

20. A method according to claim 19, further comprising the step of, at a same time as the step of adjusting the displacement of the motor unit is done, supplying a pressurized fluid in a non-throttled manner from a pump to the actuator so that the actuator performs the requested work function.

21. A method according to claim 20, further comprising the step of controlling movements of the actuator independent of which operation mode is currently in use, by adjusting the displacement of the variable displacement hydraulic motor unit.

22. A method according to claim 20, further comprising the step of sensing a speed of a power source driving the pump and adjusting the displacement of the motor unit according to the sensed speed.

23. A method according to claim 20, further comprising the step of sensing a load pressure subjected to the actuator during operation and controlling an output pressure of the pump so that it exceeds the sensed load pressure existing in the actuator by a predetermined differential.

24. A method according to claim 19, further comprising the step of sensing at least one vehicle operating parameter and adjusting the displacement of the motor unit according to the sensed operating parameter.

25. A method according to claim 19, further comprising the step of actuating the actuator by controlling a plurality of on/off valves associated with the actuator.

26. A method according to claim 19, further comprising the step of sensing operation of an operator maneuverable control means and generating the work function signal accordingly.

27. A computer program product comprising computer program segments stored on a non-transitory computer-readable medium for implementing the method as claimed in claim 19 when the program is run on a computer.

28. A method for controlling a work vehicle, comprising steps of receiving a work function operator signal from an operator of the vehicle, and depending on a requested work function in the operator signal, adjusting a displacement of a variable displacement hydraulic motor unit arranged downstream of a hydraulic actuator, which is arranged for performing the work function, for controlling movements of the actuator, and at a same time as the step of adjusting the displacement of the motor unit is done, supplying a pressurized fluid in a non-throttled manner from a pump to the actuator so that the actuator performs the requested work function.

recovering energy by transmitting energy from the motor unit to a power source, and operatively driving the pump by the power source.

29. A method for controlling a work vehicle, comprising steps of receiving at least one work function operator signal from an operator of the vehicle, and depending on a requested work function in the operator signal, adjusting a displacement of a plurality of variable displacement hydraulic motor units arranged downstream of a plurality of hydraulic actuators arranged for performing a plurality of work functions, for controlling movements of the actuator.

* * * * *

US007712309C1

(12) EX PARTE REEXAMINATION CERTIFICATE (9464th)

United States Patent
Vigholm

(10) Number: US 7,712,309 C1
(45) Certificate Issued: Jan. 3, 2013

(54) ARRANGEMENT AND A METHOD FOR CONTROLLING A WORK VEHICLE

(75) Inventor: Bo Vigholm, Stora Sundby (SE)

(73) Assignee: Volvo Construction Equipment Holding Sweden AB, Eskilstuna (SE)

Reexamination Request:
No. 90/011,909, Sep. 16, 2011

Reexamination Certificate for:

| | |
|---|---|
| Patent No.: | **7,712,309** |
| Issued: | **May 11, 2010** |
| Appl. No.: | **11/813,773** |
| Filed: | **Jul. 12, 2007** |

(21) Appl. No.: 90/011,909

(22) PCT Filed: Feb. 17, 2005

(86) PCT No.: PCT/SE2005/000226

§ 371 (c)(1),
(2), (4) Date: Jul. 12, 2007

(87) PCT Pub. No.: WO2006/088399

PCT Pub. Date: Aug. 24, 2006

(51) Int. Cl.
*F16D 31/02* (2006.01)

(52) U.S. Cl. ..... 60/414; 60/419

(58) Field of Classification Search ..... None
See application file for complete search history.

(56) References Cited

To view the complete listing of prior art documents cited during the proceeding for Reexamination Control Number 90/011,909, please refer to the USPTO's public Patent Application Information Retrieval (PAIR) system under the Display References tab.

*Primary Examiner* — William Doerrler

(57) ABSTRACT

An arrangement for controlling a work vehicle includes a power source, and a hydraulic circuit including a pump driven by the power source, at least one hydraulic actuator arranged in fluid connection with the pump via a first conduit, a variable displacement hydraulic motor unit arranged in fluid connection with the actuator and downstream the actuator via a second conduit. The variable displacement hydraulic motor unit is arranged for controlling movement of the actuator.

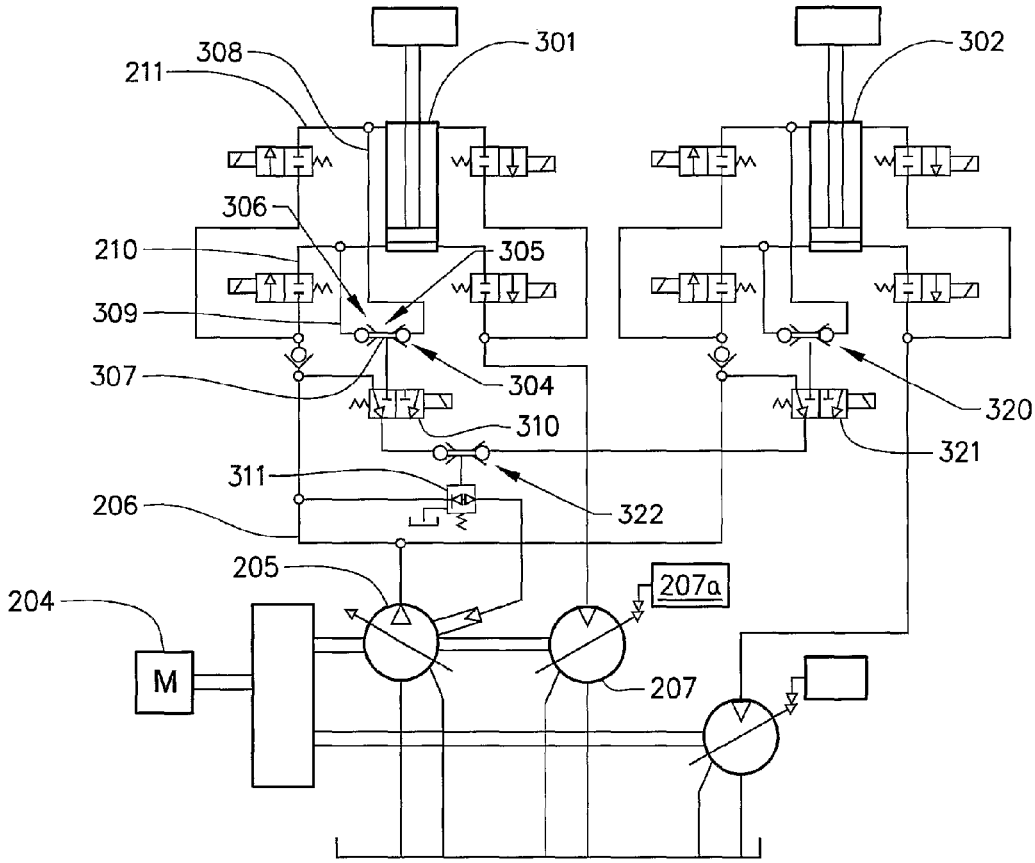

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5, 20 and 22 are cancelled.

Claims 1, 6, 12, 14, 18, 19, 21, 23, 28 and 29 are determined to be patentable as amended.

Claims 2-4, 7-11, 13, 15-17 and 24-27, dependent on an amended claim, are determined to be patentable.

New claims 30-55 are added and determined to be patentable.

1. An arrangement for controlling a work vehicle, comprising a power source, and a hydraulic circuit comprising a pump driven by the power source, at least one hydraulic actuator arranged in fluid connection with the pump via to first conduit, and a variable displacement hydraulic motor unit arranged in fluid connection with the actuator and downstream from the actuator via a second conduit wherein the variable displacement hydraulic motor unit is arranged for controlling movement of the actuator, wherein the motor unit is arranged for a rotation connection to the power source in order to transmit energy to the power source, *wherein the arrangement comprises means for disconnecting a rotation connection between the power source and the motor unit*.

6. [A control arrangement according to claim 1] *An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator*, wherein *the motor unit is arranged for a rotation connection to the power source in order to transmit energy to the power source,* the arrangement comprises a plurality of hydraulic circuits with a common pump driven by the power source, *the control arrangement comprises part of a steerable work vehicle having a load arm that is adapted to be raised and lowered and tilted, and an actuator of at least one of the plurality of hydraulic circuits is arranged to perform one of a vehicle steering, a load arm raising or lowering, or a load implement tilting function*.

12. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function, *wherein the arrangement comprises a set of valves arranged on the first and second conduit for actuating the associated hydraulic actuator, and at least one of the hydraulic actuators comprises a hydraulic cylinder having a piston side and a piston rod side, and the pump and a respective motor unit are each connected to both the piston side and the piston rod side of the at least one of the hydraulic actuators*.

14. A control arrangement according to claim 12, wherein the [arrangement] *set of valves* comprises a set of on/off valves [arranged on the first and second conduit for actuating the associated hydraulic actuator].

18. An arrangement for controlling a work vehicle, comprising a power source, an a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the pump and the motor unit are coupled in such a way to the power source that they rotate at the same speed, *and wherein the arrangement comprises means for disconnecting a rotation connection between the power source and the motor unit*.

19. A method for controlling a work vehicle, comprising steps of receiving a work function operator signal from an operator of the vehicle, [and]

depending on a requested work function in the operator signal, adjusting a displacement of a variable displacement hydraulic motor unit arranged downstream of a hydraulic actuator, which is arranged for performing the work function, for controlling movements of the actuator, [and]

transmitting energy from the motor unit via a rotation connection to a power source,

*at a same time as the step of adjusting the displacement of the motor unit is done, supplying a pressurized fluid in a non-throttled manner from a pump to the actuator so that the actuator performs the requested work function, and*

*sensing a speed of a power source driving the pump and adjusting the displacement of the motor unit according to the sensed speed*.

21. A method according to claim [20] *19*, further comprising the step of controlling movements of the actuator independent of which operation mode is currently in use, by adjusting the displacement of the variable displacement hydraulic motor unit.

23. A method according to claim [20] *19*, further comprising the step of sensing a load pressure subjected to the actuator during operation and controlling an output pressure of the pump so that it exceeds the sensed load pressure existing in the actuator by a predetermined differential.

28. A method for controlling a work vehicle, comprising steps of receiving a work function operator signal from an operator of the vehicle, [and]

depending on a requested work function in the operator signal, adjusting a displacement of a variable displacement hydraulic motor unit arranged downstream of a hydraulic actuator, which is arranged for performing the work function, for controlling movements of the actuator, [and]

at a same time as the step of adjusting the displacement of the motor unit is done, supplying a pressurized fluid in a non-throttled manner from a pump to the actuator so that the actuator performs the requested work function, recovering energy by transmitting energy from the motor unit to a power source, [and]

operatively driving the pump by the power source, *and*

*disconnecting a rotation connection between the power source and the motor unit.*

29. A method for controlling a work vehicle, comprising steps of receiving at least one work function operator signal from an operator of the vehicle, and depending on a requested work function in the operator signal, adjusting a displacement of a plurality of variable displacement hydraulic motor units arranged downstream of a plurality of hydraulic actuators arranged for performing a plurality of work functions, for controlling movements of the actuator, *and*

*inputting, via a pump, pressurized fluid to at least one actuator of the plurality of actuators to perform a plurality of operations, and outputting, via the motor unit, pressurized fluid when the plurality of operations are performed,*

*wherein the at least one actuator is adapted to be driven in a first and a second direction, the plurality of operations comprises driving the at least one actuator in the first and the second direction, and the same pump inputs hydraulic fluid and the same motor unit outputs hydraulic fluid when the plurality of operations are performed.*

*30. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the motor unit is arranged for a rotation connection to the power source in order to transmit energy to the power source, wherein the pump is arranged to input hydraulic fluid to the actuator to perform a plurality of operations and the motor unit is arranged to permit hydraulic fluid to be output from the actuator through the motor unit when the plurality of operations are performed, and the actuator is adapted to be driven in a first and a second direction, and the plurality of operations comprises driving the actuator in the first and the second direction, and the same pump inputs hydraulic fluid and the same motor unit outputs hydraulic fluid when the plurality of operations are performed.*

*31. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the motor unit is arranged for a rotation connection to the power source in order to transmit energy to the power source, wherein the pump is arranged to input hydraulic fluid to the actuator to perform a plurality of operations and the motor unit is arranged to permit hydraulic fluid to be output from the actuator through the motor unit when the plurality of operations are performed, and the pump is arranged to input hydraulic fluid to the actuator to perform a function and an opposite function and the motor unit is arranged to permit hydraulic fluid to be output from the actuator through the motor unit when the function and the opposite function are performed, and wherein the same pump inputs hydraulic fluid and the same motor unit outputs hydraulic fluid when the work function and the opposite work function are performed.*

*32. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the motor unit is arranged for a rotation connection to the power source in order to transmit energy to the power source, and the same pump is at all times upstream of the actuator and the same hydraulic motor unit is at all times downstream from the actuator.*

*33. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the motor unit is arranged for a rotation connection to the power source in order to transmit energy to the power source, and the pump is only arranged to supply a specific pressure.*

*34. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function, wherein the arrangement comprises means for disconnecting a rotation connection between the power source and the motor unit.*

*35. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function, wherein the arrangement comprises a plurality of hydraulic circuits with a common pump driven by the power source, wherein the control arrangement comprises part of a steerable work vehicle having a load arm that is adapted to be raised and lowered and tilted, and an actuator of at least one of the plurality of hydraulic circuits is arranged to perform one of a vehicle steering, a load arm raising or lowering, or a load implement tilting function.*

*36. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function, wherein the pump is arranged to input hydraulic fluid to the actuator to perform a plurality of operations and the motor unit is arranged to permit hydraulic fluid to be output from the actuator through the motor unit when the plurality of operations are performed, and the actuator is adapted to be driven in a first and a second direction, and the plurality of operations comprises driving the actuator in the first and the second direction, and the same pump inputs hydraulic fluid and the same motor unit outputs hydraulic fluid when the plurality of operations are performed.*

*37. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function, wherein the pump is arranged to input hydraulic fluid to the actuator to perform a function and an opposite function and the motor unit is arranged to permit hydraulic fluid to be output from the actuator through the motor unit when the function and the opposite function are performed, and wherein the same pump inputs hydraulic fluid and the same motor unit outputs hydraulic fluid when the work function and the opposite work function are performed.*

*38. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement hydraulic motor unit is arranged for controlling each work function, wherein the same pump is at all times upstream of the actuator and the same hydraulic motor unit is at all times downstream from the actuator.*

*39. An arrangement for controlling a work vehicle, comprising a power source, and a hydraulic circuit comprising a pump driven by the power source, at least one hydraulic, actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the arrangement comprises a plurality of hydraulic actuators for performing a plurality of work functions, and one variable displacement motor unit is arranged for controlling each work function, wherein the pump is only arranged to supply a specific pressure.*

*40. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the pump and the motor unit are each coupled to the power source, wherein the arrangement comprises a plurality of hydraulic circuits with a common pump driven by the power source, wherein the control arrangement comprises part of a steerable work vehicle having a load arm that is adapted to be raised and lowered and tilted, and an actuator of at least one of the plurality of hydraulic circuits is arranged to perform one of a vehicle steering, a load arm raising or lowering, or a load implement tilting function.*

*41. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the pump and the motor unit are each coupled to the power source, wherein the pump is arranged to input hydraulic fluid to the actuator to perform a plurality of operations and the motor unit is arranged to permit hydraulic fluid to be output from the actuator through the motor unit when the plurality of operations are performed, and the actuator is adapted to be driven in a first and a second direction, and the plurality of operations comprises driving the actuator in the first and the second direction, and the same pump inputs hydraulic fluid and the same motor unit outputs hydraulic fluid when the plurality of operations are performed.*

*42. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the pump and the motor unit are each coupled to the power source, wherein the pump is arranged to input hydraulic fluid to the actuator to perform a function and an opposite function and the motor unit is arranged to permit hydraulic fluid to be output from the actuator through the motor unit when the function and the opposite function are performed, and wherein the same pump inputs hydraulic fluid and the same motor unit outputs hydraulic fluid when the work function and the opposite work function are performed.*

*43. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the*

*variable displacement hydraulic motor unit is arranged for controlling movement of the actuator, wherein the pump and the motor unit are each coupled to the lower source, wherein the same pump is at all times upstream of the actuator and the same hydraulic motor unit is at all times downstream from the actuator.*

*44. An arrangement for controlling a work vehicle, comprising a power source, and a hydraulic circuit comprising a pump driven by the power source, at least one hydraulic actuator arranged in fluid connection with the pump via a first conduit, and a variable displacement hydraulic motor unit arranged in fluid connection with the actuator and downstream from the actuator via a second conduit wherein the variable displacement hydraulic motor unit is arranged for controlling movement of the actuator, wherein the pump and the motor unit are each coupled to the power source, wherein the pump is only arranged to supply a specific pressure.*

*45. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator, transmitting energy from the motor unit via a rotation connection to a power source, and*

*disconnecting a rotation connection between the power source and the motor unit.*

*46. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator,*

*transmitting energy from the motor unit via a rotation connection to a power source, and*

*inputting, via a pump, hydraulic fluid to the actuator to perform a plurality of operations, and outputting, via the motor unit, hydraulic fluid when the plurality of operations are performed,*

*wherein the actuator is adapted to be driven in a first and a second direction, the plurality of operations comprises driving the actuator in the first and the second direction, and the same pump inputs hydraulic fluid and the same motor unit outputs hydraulic fluid when the plurality of operations are performed.*

*47. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator,*

*transmitting energy from the motor unit via a rotation connection to a power source, and*

*inputting, via a pump, hydraulic fluid to the actuator to perform, first, the work function, and, second, an opposite work function, and outputting, via the motor unit, hydraulic fluid from the actuator when the work function and the opposite work function are performed,*

*wherein the same pump inputs hydraulic fluid and the same motor unit outputs hydraulic fluid when the work function and the opposite work function are performed.*

*48. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator,*

*transmitting energy from the motor unit via a rotation connection to a power source, and*

*supplying hydraulic fluid to the actuator via a pump that is only arranged to supply a specific pressure.*

*49. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator,*

*at a same time as the step of adjusting the displacement of the motor unit is done, supplying a pressurized fluid in a non-throttled manner from a pump to the actuator so that the actuator performs the requested work function, recovering energy by transmitting energy from the motor unit to a power source,*

*operatively driving the pump by the power source, and*

*inputting, via the pump, pressurized fluid to the actuator to perform a plurality of operations, and outputting, via the motor unit, pressurized fluid when the plurality of operations are performed,*

*wherein the actuator is adapted to be driven in a first and a second direction, the plurality of operations comprises driving the actuator in the first and the second direction, and the same pump inputs hydraulic fluid and the same motor unit outputs hydraulic fluid when the plurality of operations are performed.*

*50. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator,*

*at a same time as the step of adjusting the displacement of the motor unit is done, supplying a pressurized fluid in a non-throttled manner from a pump to the actuator so that the actuator performs, first, the requested work function and, second, an opposite of the requested work function,*

*recovering energy by transmitting energy from the motor unit to a power source,*

*operatively driving the pump by the power source,*

*wherein the same pump inputs hydraulic fluid and the same motor unit outputs hydraulic fluid when the work function and the opposite work function are performed.*

*51. A method for controlling a work vehicle, comprising steps of*

*receiving a work function operator signal from an operator of the vehicle,*

*depending on a requested work function in the operator signal, adjusting a displacement of a variable displacement hydraulic motor unit arranged downstream of a hydraulic actuator, which is arranged for performing the work function, for controlling movements of the actuator,*

*at a same time as the step of adjusting the displacement of the motor unit is done, supplying a pressurized fluid in a non-throttled manner from a pump to the actuator so that the actuator performs the requested work function, wherein the pump is only arranged to supply a specific pressure,*

*recovering energy by transmitting energy from the motor unit to a power source, and*

*operatively driving the pump by the power source.*

*52. A method for controlling a work vehicle, comprising steps of*

*receiving at least one work function operator signal from an operator of the vehicle,*

*depending on a requested work function in the operator signal, adjusting a displacement of a plurality of variable displacement hydraulic motor units arranged downstream of a plurality of hydraulic actuators arranged for performing a plurality of work functions, for controlling movements of the actuator, and*

*at a same time as the step of adjusting the displacement of the motor units is done, supplying a pressurized fluid in a non-throttled manner from a pump to at least one actuator of the plurality of actuators so that the at least one actuator performs, first, the requested work function and, second, an opposite of the requested work function, wherein the same pump inputs hydraulic fluid and the same motor unit outputs hydraulic fluid when the work function and the opposite work function are performed.*

*53. A method for controlling a work vehicle, comprising steps of*

*receiving at least one work function operator signal from an operator of the vehicle,*

*depending on a requested work function in the operator signal, adjusting a displacement of a plurality of variable displacement hydraulic motor units arranged downstream of a plurality of hydraulic actuators arranged for performing a plurality of work functions, for controlling movements of the actuator, and*

*at a same time as the step of adjusting the displacement of the motor unit is done, supplying a pressurized fluid in a non-throttled manner from a pump to at least one actuator of the plurality of actuators so that the at least one actuator performs the requested work function, wherein the pump is only arranged to supply a specific pressure.*

*54. An arrangement for controlling a work vehicle, comprising*

*a power source, and*

*a hydraulic circuit comprising a single pump driven by the power source, and a plurality of sub-circuits, each sub-circuit comprising*

*at least one hydraulic actuator arranged in fluid connection with the pump via a first conduit, and*

*a variable displacement hydraulic motor unit arranged in fluid connection with the actuator and downstream from the actuator via a second conduit wherein the variable displacement hydraulic motor unit is arranged for controlling movement of the actuator,*

*wherein the motor unit is arranged for a rotation connection to the power source in order to transmit energy to the power source.*

*55. A control arrangement according to claim 54, wherein, in each sub-circuit, the actuator comprises a hydraulic cylinder.*

* * * * *